US006435939B1

(12) United States Patent
Lin

(10) Patent No.: US 6,435,939 B1
(45) Date of Patent: Aug. 20, 2002

(54) BRASSIERE UNDERWIRING

(76) Inventor: Chien-Ming Lin, 4th Fl., 2, Alley 20, Lane 106, Chang Chiang Rd., Sec.1, Panchiao City, Taipei Hsien (TW)

( * ) Notice: Subject to any disclaimer, the term of this patent is extended or adjusted under 35 U.S.C. 154(b) by 0 days.

(21) Appl. No.: 09/964,561

(22) Filed: Sep. 28, 2001

(51) Int. Cl.[7] ..... A41C 3/00
(52) U.S. Cl. ..... 450/41; 450/45
(58) Field of Search ..... 450/41, 45–52; 2/255–261, 264

(56) References Cited

U.S. PATENT DOCUMENTS 3,114,374 A * 12/1963 Chalfin et al. ..... 450/41
3,562,802 A * 2/1971 Avis ..... 450/41
3,605,753 A * 9/1971 Schwartz ..... 450/41
5,730,640 A * 3/1998 Acx et al. ..... 450/41
6,053,800 A * 4/2000 Lattanzi ..... 450/41

* cited by examiner

*Primary Examiner*—Gloria M. Hale
(74) *Attorney, Agent, or Firm*—Rosenberg, Klein & Lee

(57) ABSTRACT

A brassiere underwiring having a smoothly arched resilient wire rod member, and an elastomeric covering layer molded from silicon rubber or latex on the outside wall of the resilient wire rod member and fixedly bonded to the inside wall of the brassiere, the elastomeric covering layer having a soft contact surface adapted to contact the skin of the user's breasts, the thickness of the elastomeric covering layer between the resilient wire rod member and the soft contact surface being greater than the thickness of the resilient wire rod member.

7 Claims, 5 Drawing Sheets

BRASSIERE UNDERWIRING

BACKGROUND OF THE INVENTION

The present invention relates to brassieres and, more specifically, to a brassiere underwiring.

A brassiere is a small, tight undergarment worn by women over their breasts. In order to lift the breasts, a brassiere has an underwiring structure. A regular brassiere 1, as shown in FIG. 1, has two cups 11 for the breasts, an underwiring 12 arranged along the bottom side of each of the cups 11. The underwiring 12 is a steel wire fastened a fabric piping 13 at the bottom side of each of the cups 11, or wrapped with velvet and then stitched to the bottom side of each of the cups 11. The presence of the steel wire at the bottom side of each of the cups 11 gives a pressure to the lower side of the breasts, causing the user to feel uncomfortable. Further, this structure of underwiring 12 tends to slip. In order to hold the underwiring 12 of each cup 11 positively in place after the user has worn the brassiere over the breasts, the shoulder straps 14 must be fastened tight. However, it is uncomfortable to fasten the shoulder straps 14 tightly.

SUMMARY OF THE INVENTION

The present invention has been accomplished to provide a brassiere underwiring, which eliminates the aforesaid problems. It is one object of the present invention to provide a brassiere underwiring, which makes the brassiere comfortable in use. It is another object of the present invention to provide a brassiere underwiring, which prohibits the brassiere from slipping. According to one aspect of the present invention, the brassiere underwiring comprises a smoothly arched resilient wire rod member, and an elastomeric covering layer molded from silicon rubber or latex on the outside wall of the resilient wire rod member and fixedly bonded to the inside wall of the brassiere. According to another aspect of the present invention, the elastomeric covering layer has a soft contact surface adapted to contact the skin of the user's breasts, and the thickness of the elastomeric covering layer between the resilient wire rod member and the soft contact surface is greater than the thickness of the resilient wire rod member.

DETAILED DESCRIPTION OF THE PREFERRED EMBODIMENT

Figure 1:
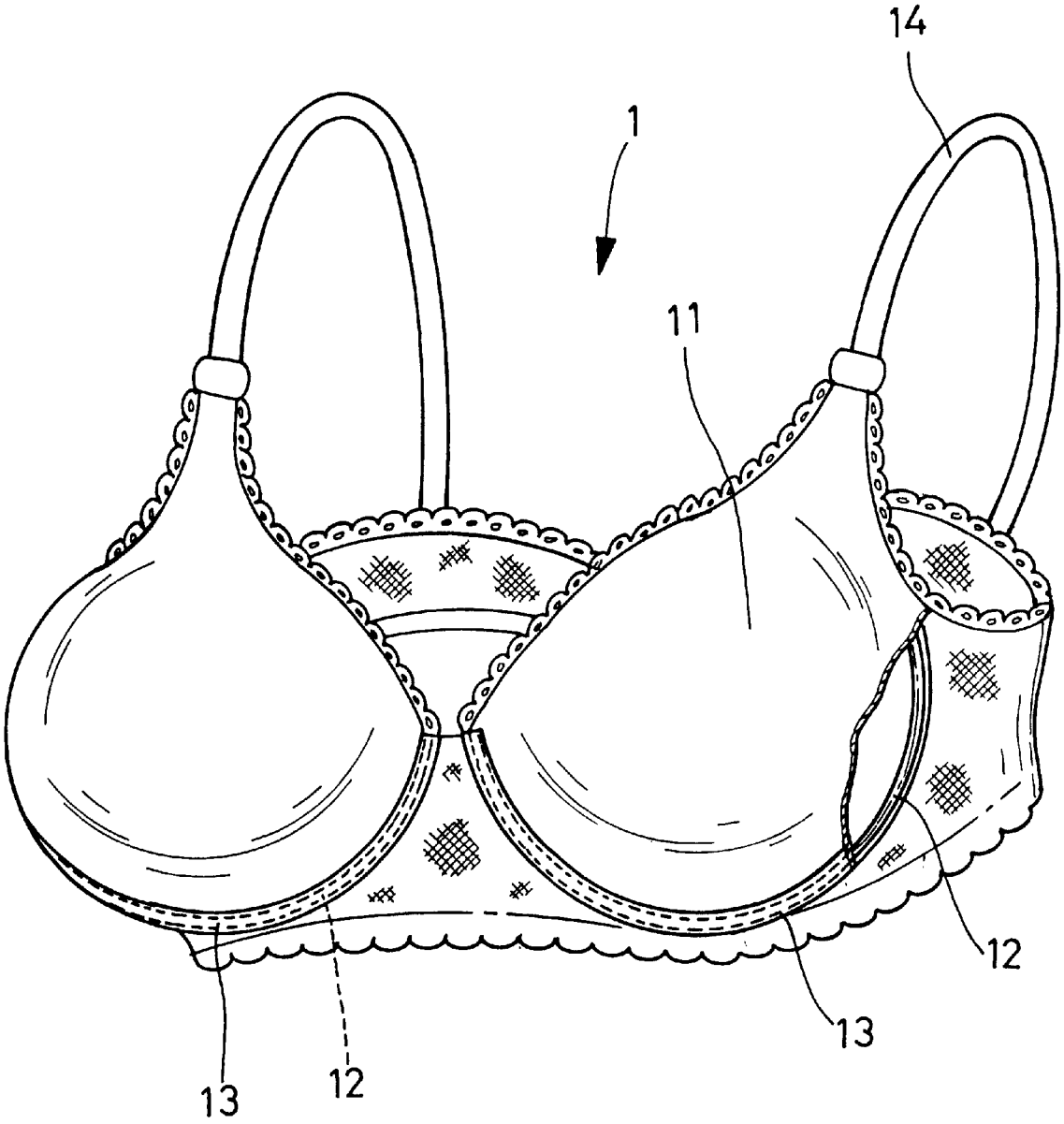
FIG.1 PRIOR ART
FIG. 1 is an elevational view of a brassiere constructed according to the prior art.
Figure 2:
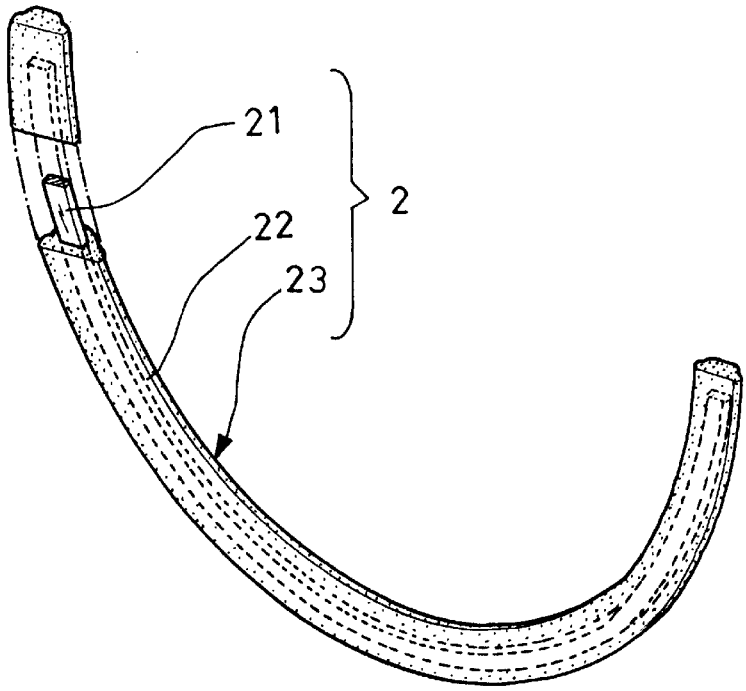
FIG. 2 is a perspective view of a brassiere underwiring according to the present invention.
Figure 3:
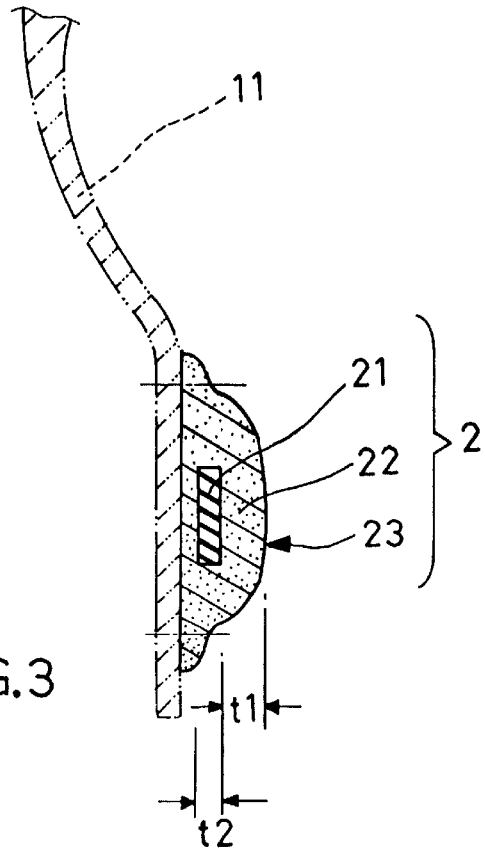
FIG. 3 is a cross sectional view showing the brassiere underwiring installed in the cup according to the present invention.

Referring to FIGS. 2 and 3, a brassiere underwiring 2 is fixedly fastened to the inside wall of the brassiere 1 along the smoothly arched bottom side of each cup 11. The brassiere underwiring 2 comprises a smoothly arched resilient wire rod member 21, an elastomeric covering layer 22 directly molded on the periphery of the resilient wire rod member 21. The resilient wire rod member 21 can be made of iron, stainless steel, titanium, or ABS (alkyl acrylonitrile-butadiene-styrene). Preferably, the resilient wire rod member 21 has a flat cross-section, as shown in FIG. 3. The elastomeric covering layer 22 can be obtained from silicon rubber, latex, or any of a variety of non-toxic rubber materials that are not allergic to the skin. Further, the elastomeric covering layer 22 has a soft contact layer 23 adapted to contact the skin of the breast. The thickness t1 of the elastomeric covering layer 22 between the resilient wire rod member 21 and the soft contact surface 23 is greater than the thickness t2 of the resilient wire rod member 21.

Figure 4:
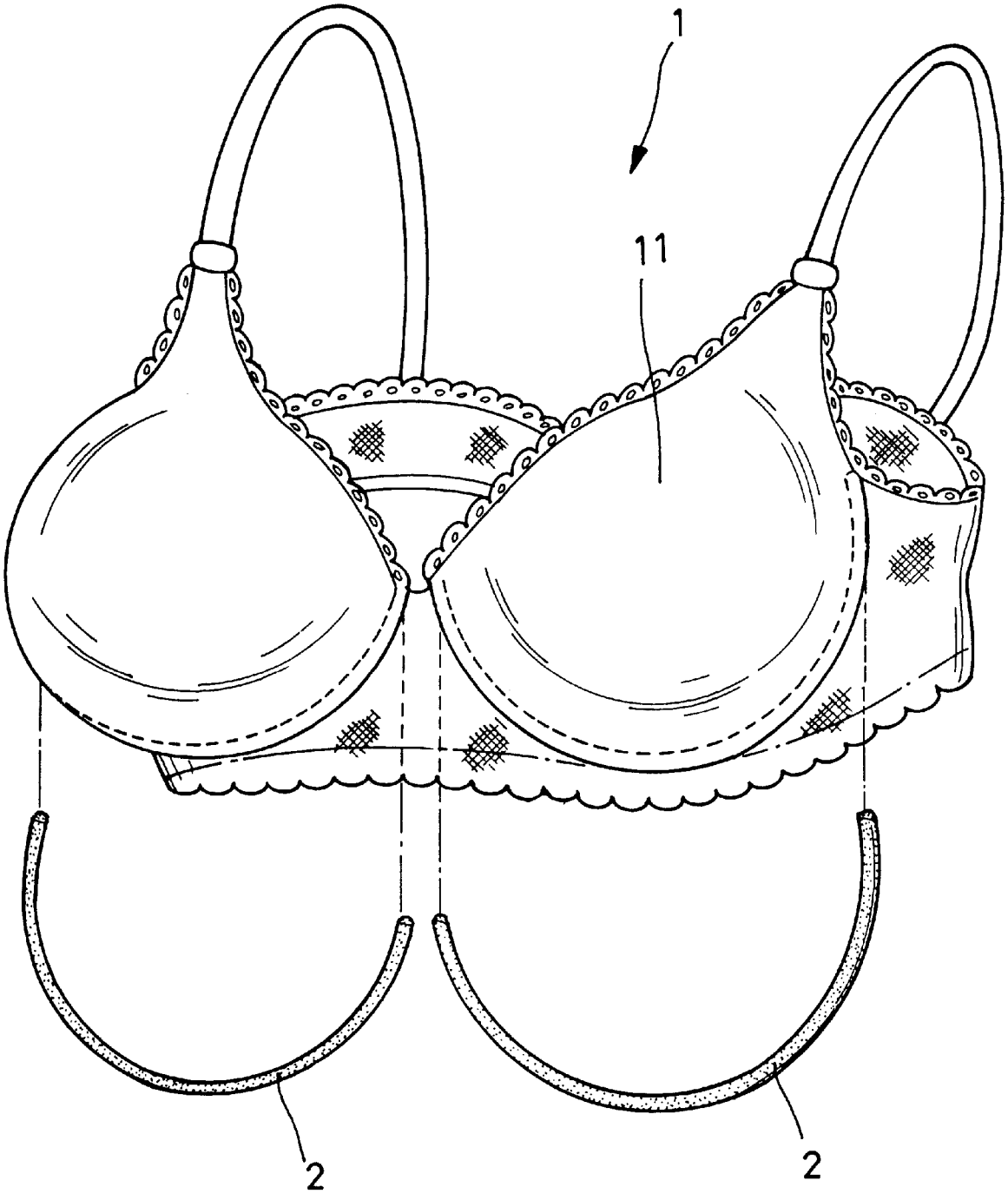
FIG. 4 is an exploded view of a brassiere and the underwirings according to the present invention.
Figure 5:
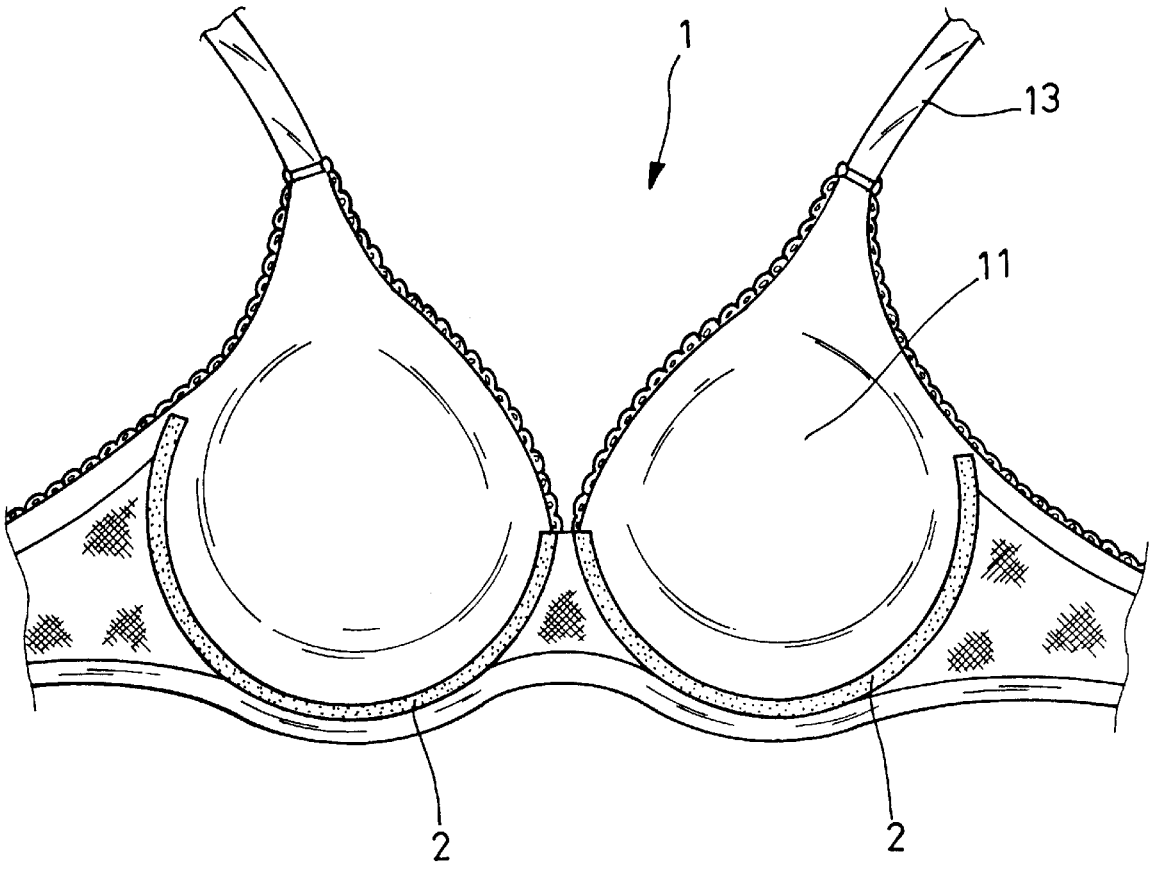
FIG. 5 is an assembly view of FIG. 4.

Referring to FIGS. 4 and 5, the brassiere underwiring 2 can be fastened to the brassiere 1 along the smoothly arched bottom side of each of the cups 11 by an adhesive, a high-frequency sealing apparatus, or stitches. When installed, the brassiere underwiring 2 and the brassiere 1 are united tightly.

Figure 6:
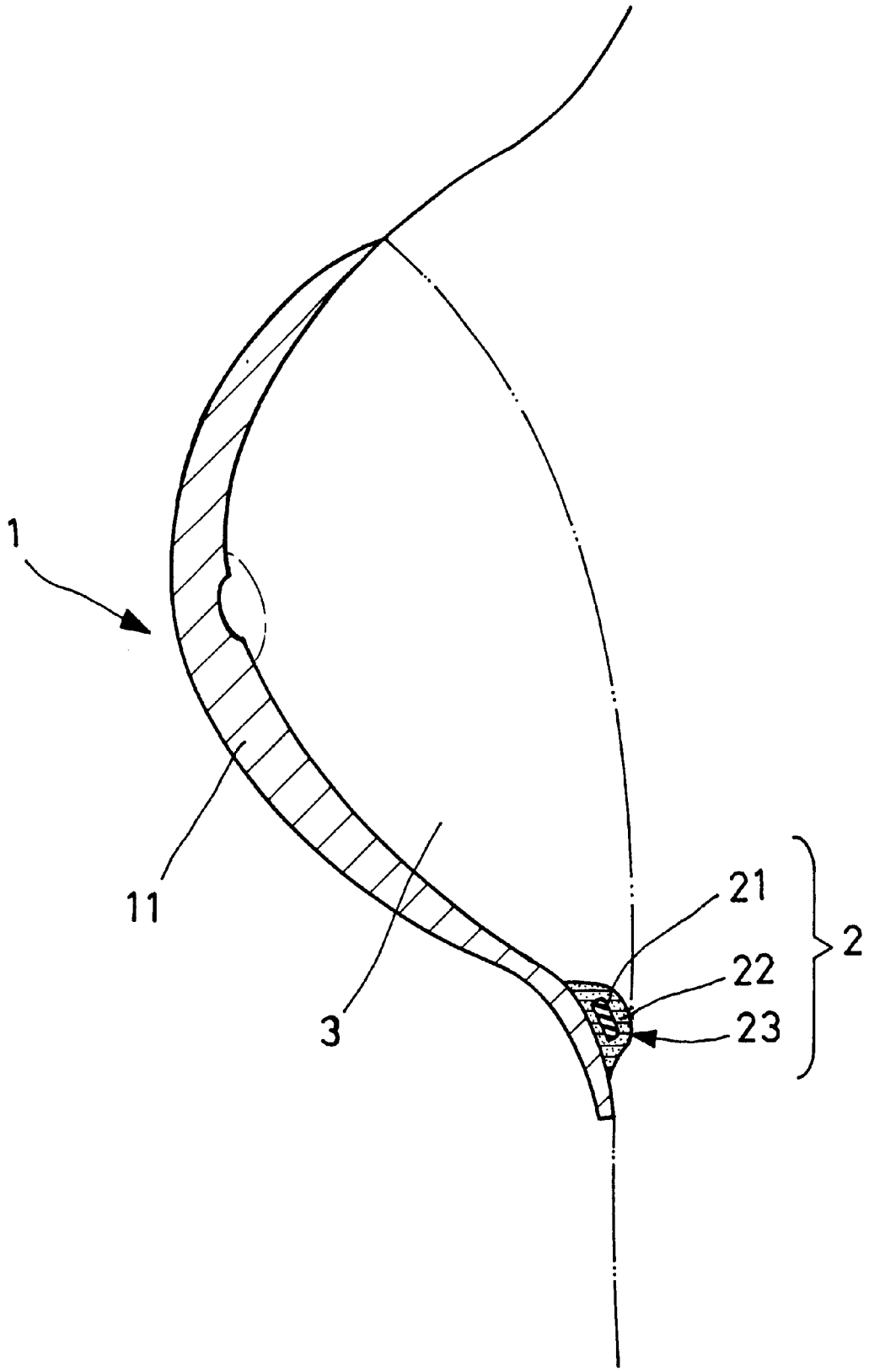
FIG. 6 is a schematic drawing showing the brassiere worn over the breasts according to the present invention.

Referring to FIG. 6, after put the brassiere 1 over the breasts 3, the soft contact surface 23 of the elastomeric covering layer 22 of the brassiere underwiring 2 is disposed in contact with the skin of the breasts without giving a compressive pressure to the skin. Because the brassiere underwiring 2 does not slip on the skin, it is not necessary to fasten the shoulder straps 13 excessively tight. Therefore, the brassiere 1 is comfortable in use. After removal of the brassiere 1 from the breasts, no squeezing trace is left on the skin.

A prototype of brassiere underwiring arrangement has been constructed with the features of the annexed drawings of FIGS. 2~6. The brassiere underwiring arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A brassiere underwiring fixedly fastened to an inside wall of a brassiere along an arched bottom side of each of a pair of cups of the brassiere, comprising a resilient wire rod member having an arched contour, and an elastomeric covering layer molded on an outside wall of said resilient wire rod member and fixedly fastened to the inside wall of the brassiere, said elastomeric covering layer having a soft contact surface adapted to contact skin of a user's breasts, said elastomeric covering layer having a thickness between said resilient wire rod member and said soft contact surface being greater than a thickness of said resilient wire rod member.

2. The brassiere underwiring as claimed in claim 1 wherein said resilient wire rod member is made of iron.

3. The brassiere underwiring as claimed in claim 1 wherein said resilient wire rod member is made of stainless steel.

4. The brassiere underwiring as claimed in claim 1 wherein said resilient wire rod member is made of titanium.

5. The brassiere underwiring as claimed in claim 1 wherein said resilient wire rod member is made of ABS (alkyl acrylonitrile-butadiene-styrene).

6. The brassiere underwiring as claimed in claim 1 wherein said elastomeric covering layer is molded from silicon rubber.

7. The brassiere underwiring as claimed in claim 1 wherein said elastomeric covering layer is molded from latex.

* * * * *